US005865236A

United States Patent [19]

Hansen et al.

[11] Patent Number: 5,865,236

[45] Date of Patent: Feb. 2, 1999

[54] CRUSHED AND GRADED MAGNETITE ORE FOR MANUFACTURING MOULDS AND CORES

[75] Inventors: Preben Nordgaard Hansen, Ålsgårde; Niels W. Rasmussen, Frederiksberg C; Emil Jespersen, Glostrup, all of Denmark

[73] Assignee: Georg Fischer Disa A/S, Herlev, Denmark

[21] Appl. No.: 817,439

[22] PCT Filed: Oct. 4, 1995

[86] PCT No.: PCT/DK95/00397

§ 371 Date: Apr. 11, 1997

§ 102(e) Date: Apr. 11, 1997

[87] PCT Pub. No.: WO96/11761

PCT Pub. Date: Apr. 25, 1996

[30] Foreign Application Priority Data

Oct. 13, 1994 [DK] Denmark ..... 1183/94
Jul. 6, 1995 [DK] Denmark ..... 0794/95

[51] Int. Cl.[6] ..... B22C 1/00; B22C 1/18; B22C 9/00

[52] U.S. Cl. ..... 164/5; 106/38.9; 164/138; 164/529

[58] Field of Search ..... 164/529, 138, 164/5; 106/38.9, 38.2

[56] References Cited

U.S. PATENT DOCUMENTS

| | | | |
|---|---|---|---|
| 1,770,688 | 7/1930 | De Witt . | |
| 3,619,866 | 11/1971 | Hofmann et al. | 164/529 X |

FOREIGN PATENT DOCUMENTS

| | | | |
|---|---|---|---|
| 28526/92 | 5/1993 | Austria . | |
| 848843 | 8/1970 | Canada | 164/529 |
| 2009324 | 1/1970 | France | 164/529 |
| 47-31213 | 8/1972 | Japan | 164/529 |
| 53-26225 | 3/1978 | Japan . | |
| 59-54442 | 3/1984 | Japan . | |
| 707672 | 1/1980 | Russian Federation | 164/529 |
| 900962 | 1/1982 | Russian Federation | 164/529 |
| 946786 | 7/1982 | Russian Federation | 164/529 |
| 1719147 | 3/1992 | Russian Federation | 164/529 |
| 814547 | 3/1981 | U.S.S.R. . | |
| 833352 | 5/1981 | U.S.S.R. . | |
| 522695 | 7/1983 | U.S.S.R. . | |
| 1297981 | 3/1987 | U.S.S.R. . | |

OTHER PUBLICATIONS

Patent Abst. of JP, vol. 76, No. 53119x; JP Appln. No. 57–61428 Published May 29, 1976.

38th Int'l Foundry Cong.; Wittmoser et al. —Magnetic moulding . . . , Kyoto, JP, 1971.

*Primary Examiner*—J. Reed Satten, Jr.
*Attorney, Agent, or Firm*—Larson & Taylor

[57] ABSTRACT

Crushed and graded magnetite ore is mixed with clay to form foundry moulds and cores. These moulds or cores are useful when casting non-ferrous metals or alloys, especially light metals and light-metal alloys.

24 Claims, No Drawings

CRUSHED AND GRADED MAGNETITE ORE FOR MANUFACTURING MOULDS AND CORES

TECHNICAL FIELD

The present invention relates to the use of crushed and graded ore, preferably magnetite ore, for manufacturing moulds and cores (i.e., mould elements) for use in casting non-ferrous metals or alloys, especially light metals and light-metal alloys.

Magnetite is a ferromagnetic mineral with the stoichiometric composition $Fe_3O_4$. In the present context, the expression "graded" is used to indicate that the ore, after having been crushed, has been subjected to a certain particle-size sorting, e.g. by screening, air separation or flotation, as it is well-known for particulate materials such as sand.

BACKGROUND ART

Up to the present, the particulate mineral base material used for manufacturing moulds and cores has practically exclusively been quartz sand.

Admittedly, it is not unknown within the foundry industry also to use other particulate mineral base materials such as olivine sand, a magnesium-iron silicate, and zircon sand, a zirconium silicate. Due to their high resistance to heat and their high price, these base materials have especially found localized use as so-called "pattern sand" or as a core inlay in such regions of moulds for casting steel castings that are particularly exposed to heat, so as to avoid or reduce the "burning-on" of sand on corresponding regions of the castings and the consequent cumbersome and costly cleaning of the castings.

A corresponding use has been found for crushed chromite ore, as with this mineral it is also the case that its wetting relations towards liquid steel are such, that it simply "repels" the latter.

No examples are known of such particulate mineral base materials having been used in a larger mass of circulating mould material, let alone for casting non-ferrous metals or alloys.

In a paper (38th International Foundry Congress, Exchange Paper No. 9, Düsseldorf, 1971) "Möglichkeiten der industriellen Anwendung des Magnetformverfahrens zur Herstellung von Massengussteilen" by A. Wittmoser, K. Steinack and R. Hofman, mass production of castings is described, based on a mass production of heat-gasifiable patterns of expanded polystyrene foam. These patterns are covered by being sprayed with or dipped into a coating (Schlichte), after which they are enveloped with a flowable mixture of iron granulate and crushed magnetite ore, possibly in a fluidized state. Prior to the casting operation, a magnetic field is applied to the mould material so as to bond its individual particles together magnetically, said field being maintained during the casting proper and at least a part of the time, during which the metal solidifies in the mould. When the magnetic field has been removed, the mould material, now again being flowable, flows away from the casting, after which it may be used in new moulds, possibly after having been cooled. The paper, exclusively relating, to the casting of ferrous alloys, mentions the higher cooling effect of the mould material as compared to quartz sand, and also discusses how this cooling effect may be varied by changing the quantitative ratio between iron granulate and magnetite particles in the mould material, so that an increased proportion of magnetite particles reduces the cooling effect.

Obviously, this method cannot be used in a conventional moulding and casting system.

For casting light-metal castings, especially for use in the automotive and similar industries, there is, however, a great need for achieving a more rapid cooling of the metal having been cast in the mould, as this makes it possible to achieve a more fine-grained structure in the casting and also to avoid so-called micro-contraction cavities in the castings.

At the present time, attempts are made to achieve such more rapid cooling by casting in so-called metallic moulds (dies). Such moulds are, however, costly to manufacture, and in comparison with casting in a conventional moulding and casting system based on the use of sand, their productive capacity is very limited.

DISCLOSURE OF THE INVENTION

It is the object of the present invention to show how it is possible, in a conventional moulding and casting plant based on the use of sand, to achieve rates of cooling approximating those that can be achieved in metallic moulds.

According to the present invention, this object is achieved by the use of a crushed and graded ore, preferably magnetite ore, as a particulate mineral base material in a recyclable or non-recyclable mould or core material, respectively, for manufacturing dry or green, preferably clay-bonded, especially bentonite-bonded, in-box moulds or boxless moulds, and cores for placing in such moulds or in metallic moulds (dies), preferably when casting non-ferrous metals or alloys, especially light metals and light-metal alloys.

Compared to the use of quartz sand as base material, this primarily means that the metal having been cast in the moulds solidifies more rapidly, and that the castings, especially light-metal castings, in this process are given a more fine-grained and "denser" structure, approximately corresponding to what can be achieved by die casting. I.e., that in a conventional moulding and casting system based on the use of moulding sand, and with the relatively low pattern costs and high productive capacity associated with such plants, it is possible to achieve a quality in the castings at least approximately on the level with what can be achieved by using die-casting systems with considerably higher mould costs and lower operating rate.

A second advantage is that with the use according to the invention, it is possible to make the cooling section of a moulding and casting system substantially shorter, thus saving space.

A third advantage is that the quantity of moulding material being recycled can be reduced in comparison to the use of quartz sand as base material, thus partly compensating for the use of the—after all—costlier base material.

A fourth advantage pointing in the same direction may be seen from the following: For environmental reasons, it is relatively costly to store or deposit used and discarded mould material based on quartz sand, but in the case of discarded mould material based on magnetite ore, it is not only possible to dispose of this free of charge, but possibly even also with an economic advantage, as this material may, without further processing, be utilized for producing iron, not only in blast furnaces, but in practically any furnace for melting iron or steel.

Yet another advantage with the use of magnetite ore as base material is that this material, in contrast to quartz sand, cannot give rise to the occurrence of the pulmonary disease silicosis.

An advantage of using this material for cores to be placed in metallic dies is that, in contrast to metal cores, such cores may be shaped in any desired manner and still have a substantially greater cooling capability than a corresponding core of quartz sand.

With the use according to the invention it has proved advantageous that the base material has a particle-size distribution mainly in the interval of 0.05 mm to 0.5 mm, preferably in the interval of 0.1 to 0.25 mm, and mainly lying within three standard mesh screens.

The mould material used for the moulds may advantageously be clay-bonded wet mould material produced by mixing the base material with preferably 2–20% by weight of bentonite, preferably 1–5% by weight of water and optionally preferably 1–10% by weight of additives. The bentonite being used preferably being a naturally occurring Na-bentonite (western bentonite) or a so-called "active bentonite", i.e. a Ca-bentonite (southern type) having been converted to Na-bentonite by ion exchange. Bentonite is a commonly used bonding agent in the foundry industry.

Alternatively, the mould material may be produced by mixing the base material with preferably 5–10% by weight of cement, preferably 1–5% by weight of water and optionally 1–10% by weight of additives. In both cases the moulds may, have been dried up to a temperature of approximately 400° C. prior to the casting, have been dried prior to the casting.

As a second or further alternative, the mould material may have been produced by mixing the base material with preferably 5–10% by weight of water glass and optionally 1–10% by weight of additives, and if so, the moulds may have been made to set or harden prior to casting by being blown through by $CO_2$.

In all three cases, the additives are preferably chosen from the group comprising coal dust, cereals and ground wood, but this does not exclude the use of other additives.

With the use according to the invention, the cores preferably consist of a core material produced by mixing the base material with a bonding agent chosen from the group comprising settble and self-setting organic or inorganic core-bonding agents in solid or liquid form, possible know per se, the core material possibly having been hardened or made to set by heating or by being blown through with a gaseous hardening or setting agent.

The cores may, however, also be composed of clay-bonded wet core material with a composition as noted above and hardened or made to set by freezing, the refrigeration of the core boxes e.g. being achieved by using a gas, such as nitrogen. In this manner, the core will produce an extra strong cooling effect, that may be desirable for certain applications, e.g. the afore-mentioned use of the core in metallic moulds.

Preferably, a part of the mould and core material arising from the shake-out operation is reworked to form mould material by mixing with a suitable percentage by weight of water and optionally with a suitable percentage by weight of argillaceous bonding agent, whilst in this case, the addition of water and bonding clay is preferably attuned in such a manner, that the moulding material being recirculated will have the desired moulding properties.

The remainder of the mould and core material arising from the shake-out operation may be subjected to a regeneration and re-use as a base material as noted above, it being possible with such a regeneration process to use methods and apparatuses well-known for similar treatment of mould and core material based on quartz sand, but in addition supplemented with a magnetic separation, due to the magnetic properties of the base material.

Alternatively, the base material in the part not having been reworked may be utilized in a metallurgical process for producing a metal. This means that the surplus quantity of used moulding material does not have to be stored or deposited at great cost as in the case of quartz sand as base material, but may profitably be utilized in metal-winning processes—in the case of magnetite, this may be carried out in conventional iron or steel casting furnaces or in iron-melting furnaces, optionally with a prior pelletization of the magnetite material.

DESCRIPTION OF THE PREFERRED EMBODIMENTS

In the following part of the present description, the invention will be explained in more detail, i.a. on the basis of comparative examples of moulding material based on crushed and graded magnetite ore and based on quartz sand, respectively.

In the "technological" trials discussed below, the commonly used sand-testing equipment from the firm of Georg Fischer A. G., Schaffhausen, Switzerland, has been used, and the testing instructions given by this firm have been followed.

A parameter exhibiting a decisive difference between the magnetite sand and the quartz sand being used is the weight per unit volume of the dry base sand, i.e. the weight of e.g. one liter consolidated sand in kilogrammes, for magnetite sand amounting to approx. 2.8 and for quartz sand approx. 1.5. Further, the cooling effect of magnetite sand amounts to approx. 1500 $J/m^2s^{1/2}$° K. as against approx. 1000 $J/m^2s^{1/2}$° K. for quartz sand.

For use in comparative tests, the following mixtures were produced in a laboratory mixer:

I. MAGNETITE SAND: 4.5 kg of magnetite sand was mixed for 7 minutes with 300 g of active bentonite ("Geko"®) and 63 g of water, after screening being subjected to the tests indicated in Table 1.

II. QUARTZ SAND: 2.5 kg of quartz sand was mixed for 7 minutes with 300 g of active bentonite ("Geko"®) and 63 g of water, after screening being subjected to the tests indicated in Table 1.

TABLE 1

| | Magnetite sand | Quartz sand |
|---|---|---|
| Weight of standard test sample 50 mm × 50 mm diam. | 250 | 146 |
| Compression strength p/cm$^2$ | 1250 | 1600 |
| Shear strength p/cm$^2$ | 230 | 300 |
| Gas permeability | 60 | 120 |

Test moulds with the dimensions 36 mm dia.×185 mm were produced using the same pattern and the mould-sand mixtures described in I and II above, said test moulds being cast with AlSi7Mg at 680° C. At the same time test pieces of corresponding dimensions were cast in a metal mould, and the following parameters were determined:

DAS, i.e. dendrite arm spacings in $\mu$m $t_s$, i.e. solidification time, in seconds

TABLE 2

| | Metal moulds | Magnetite sand | Quartz sand |
|---|---|---|---|
| DAS | 36 | 38 | 44 |
| $t_s$ | 47 | 55 | 85 |

These figures show quite clearly the greater cooling effect of the magnetite sand as compared to quartz sand, while the micro-structure of the samples cast in magnetite-sand moulds was approx. 13.6% "denser" (more "fine-grained") than in samples cast in quartz-sand moulds, their solidification time being reduced by approx. 35% compared to that for samples cast in quartz-sand moulds. It can also be seen that for both parameters mentioned, values are achieved approximating those achieved by casting in a metal mould.

In addition to the uses described above, it would be near at hand for a person skilled in this art to use cores as described above in moulds having quartz sand as base material, so as to achieve both the associated improved cooling effect and the reduced force of buoyancy of the cores after casting of the mould. In that case, the magnetite sand may easily be separated magnetically from the quartz sand after shake-out, thus partly recovering the magnetite sand, partly avoiding contamination of the circulating quartz sand with core sand and core-bonding agents.

In the above description, the use according to the invention tion has been described in connection with the casting of light-metal alloys, but it will be understood that said use may also be carried out when casting e.g. non-ferrous copper alloys or even ferrous metals, such as cast iron.

We claim:

1. A mould element for use in casting of light metals and alloys comprising:

a mineral base material of crushed magnetite ore providing a majority component of the mould element; and a clay which bonds the base material together.

2. A mould element as claimed in claim 1, wherein said crushed magnetite ore has a particle-size distribution mainly in the range of 0.05 mm to 0.5 mm.

3. A mould element as claimed in claim 2, wherein the particle-size distribution lies mainly in the range of 0.1 mm to 0.25 mm.

4. A mould element as claimed in claim 1, wherein said magnetite ore is formed into a core which is placed in a mould, and said base material for the core is not titanomagnetite iron sand.

5. A mould element as claimed in claim 1, wherein said clay is bentonite.

6. A mould element as claimed in claim 5, wherein said base material is mixed with 2–20% by weight of bentonite and 1–5% by weight of water.

7. A mould element as claimed in claim 6, and further including 1–10% by weight of additives.

8. A mould element as claimed in claim 6, wherein said base material, bentonite and water are dried at a temperature of up to approximately 400° C.

9. A mould element as claimed in claim 7, wherein said additives are chosen from the group comprising coal dust, cereals and groundwood.

10. A mould element as claimed in claim 4, wherein said clay is chosen from the group comprising settable and self-setting organic and inorganic argillaceous core-bonding agents.

11. A mould element as claimed in claim 10, wherein said base material and clay are set by heating.

12. A mould element as claimed in claim 10, wherein said base material and clay are set by being blown through with a gaseous agent.

13. A mould element as claimed in claim 6, wherein said base material, bentonite and water are set by freezing.

14. A process for casting light metals and alloys comprising the steps of:

forming a mould material into a mould element, said mould material comprising a mineral base material of crushed magnetite ore providing a majority component of the mould element and a clay which bonds the base material together; and casting a light metal or light metal alloy in the mould element.

15. A process for casting as claimed in claim 14, wherein said forming step includes the selection of the magnetite ore with a particle-size distribution mainly in the range of 0.05 mm to 0.5 mm.

16. A process for casting as claimed in claim 14, wherein said magnetite ore is formed into a core which is placed in a mould, and said base material for the core is not titanomagnetite iron sand.

17. A process for casting as claimed in claim 14, and further including the steps of:

shaking out the mould element, after said casting step;

recovering at least part of the mould element material from the shaking step; and reworking the recovered mould element material to form a new mould element, said reworking step including the step of mixing the recovered mould element material with water.

18. A process for casting as claimed in claim 17, wherein said mixing step further includes the mixing of an argillaceous bonding agent with the recovered mould element material.

19. A process for casting as claimed in claim 14, and further including the steps of:

shaking out the mould element, after said casting step;

recovering a part the mould element material from the shaking step as a recovered mould element material;

regenerating the recovered mould element material;

reusing of the regenerated recovered mould element material in said forming step as part of the base material.

20. A process for casting as claimed in claim 19, wherein said regenerating step includes magnetic separation.

21. A process for casting as claimed in claim 14:

wherein said clay is bentonite; and wherein said forming step includes the steps of mixing the base material with 2–20% by weight of bentonite and 1–5% by weight of water, and drying the mixture of the base material, bentonite and water at a temperature of up to approximately 400° C.

22. A process for casting as claimed in claim 14, wherein said forming step includes the step of heating a mixture of the base material and clay to set the mixture.

23. A process for casting as claimed in claim 22, wherein said heating step includes the step of blowing a gaseous agent through the mixture of the base material and clay.

24. A process for casting as claimed in claim 14:

wherein said clay is bentonite; and wherein said forming step includes the steps of mixing the base material with 2–20% by weight of bentonite and 1–5% by weight of water, and freezing the mixture of the base material, bentonite and water to set the mixture.

* * * * *